US005947781A

United States Patent [19]

VonWald et al.

[11] Patent Number: 5,947,781

[45] Date of Patent: Sep. 7, 1999

[54] ADJUSTABLE, HIGH WRAP WAKEBOARD BINDING, SYSTEM AND METHOD

[75] Inventors: Michael VonWald; Robert L. Dunn, both of Redmond, Wash.

[73] Assignee: Earth & Ocean Sports, Inc., Hyannis, Mass.

[21] Appl. No.: 09/157,857

[22] Filed: Sep. 21, 1998

[51] Int. Cl.[6] ..... B63B 35/85

[52] U.S. Cl. ..... 441/70

[58] Field of Search ..... 114/39.2; 441/68, 441/70; 280/607, 617, 618

[56] References Cited

U.S. PATENT DOCUMENTS 5,624,291 4/1997 McClaskey ..... 441/70

FOREIGN PATENT DOCUMENTS 65793 3/1956 France ..... 441/70

*Primary Examiner*—Ed L. Swinehart
*Attorney, Agent, or Firm*—Richard P. Crowley

[57] ABSTRACT

An adjustable wakeboard binding for use on a wakeboard comprising sheet material to form a heel assembly and a forefoot assembly of a boot-like enclosure. The binding is adjustable to a desired tension and foot size of a user by the use of hook and loop-type fastener materials.

21 Claims, 5 Drawing Sheets

ADJUSTABLE, HIGH WRAP WAKEBOARD BINDING, SYSTEM AND METHOD

BACKGROUND OF THE INVENTION

Wakeboard bindings are used on wakeboards, which wakeboards are designed to be towed behind a watercraft. Such wakeboard bindings may vary in style and shape, but provide for a boot-like, generally open-toe enclosure with a support plate, planar foot pad, and a series of sheet materials to form a heel enclosure, a forefoot enclosure, and overlay bindings. The lower section of the sheet material is secured through various threaded-type fasteners to a rigid support plate, such as an aluminum plate, which may or may not have a thin cushion layer on the bottom thereof.

One of the problems with present bindings is that the bindings are not easily and readily adjustable from user to user, particularly when the bindings are high wrap-type bindings, that is, when the rear of the heel enclosure and the tongue of the forefoot extends upwardly and about the ankle, and typically, each includes a loop or series of holes at the upper portion of the heel and tongue material to allow a user to insert fingers into the holes and loop to aid in adjusting and placing the foot in the binding.

It is therefore desirable to provide for a new and improved wakeboard binding which allows users of many different foot sizes to use the same binding, and rapidly and efficiently to experience the performance of a traditional, more expensive, detail high wrap binding, which are not offered by current heel strap bindings, which may offer a range of adjustability, but lack full foot support needed to provide for the comfort of a user on the wakeboard.

Moreover, it is currently desirable to provide for a high wrap wakeboard binding that offers not only support, but may be suitable for multiple users, due to specific sizing requirements, and without any or undue readjusting of the threaded or bolted-type fasteners to the support plate.

Thus, it is desirable to provide for a new and improved adjustable wakeboard binding offering a blend of unique features at low cost, to allow for variation in performance and enhanced wakeboard control, while accommodating riders with varying and adjustable foot size.

SUMMARY OF THE INVENTION

The invention relates to an adjustable, high wrap wakeboard binding and to a binding system and method. In particular, the invention relates to an easily adjustable, hook and loop-type fastenable wakeboard binding which has a wide range of rapid adjustability, with control to the foot of a user.

In particular, the wakeboard binding of the invention provides for a specially engineered, overlapping, elastomeric; typically metallocene rubber, two piece, heel-toe assembly which adjusts easily to the forefoot height and volume of a user, to permit a custom fit for a user and employing overlay bindings fastened at the rear of the heel assembly.

The toe or forefoot assembly fastens with strong industrial hook and loop-type fasteners of the VELCRO® (trademark and a brand of fastening tape consisting of opposing pieces of fabric, one with dense arrangement of tiny nylon hooks and the other with a dense nylon pile, that interlock when pressed together, used as a closure on garments, luggage, etc. in place of button, zippers, and the like.) or other removable, adjustable-type material, adhesive-type to maintain a custom fit position for a rider during use. In addition, the wakeboard binding provides a double wrapping binding overlay which fastens in a crisscross manner around the forefoot (the top of the forefoot assembly), extends around the ankle of a user, and is secured to the back portion of the heel assembly, providing for the support, comfort, and feel of a traditional high wrap wakeboard binding, which fastens adjustably to a desired tension, set by a rider, by an overlapping hook and loop-type arrangement to the exterior surface of heel.

With the new and improved binding, a wakeboard rider may now easily adjust the binding to provide the amount of control and support desired for the particular level of wakeboard riding desired, by rapidly adjusting the binding, and by removing and adjusting the wraps and/or toe assembly, as required, for use of the binding by more than one rider.

The adjustable wakeboard binding is designed to fit a wide range of foot sizes, for example, from size to 6 to 13 (U.S. mens), which will allow each person employing the wakeboard binding to enjoy the performance of a high wrap wakeboard binding without spending valuable riding time searching for tools to adjust the threaded fasteners, or to clutter the watercraft with many different size wakeboard bindings.

The combination of adjustability, comfort, and support translates into significant greater control of the wakeboard, quicker learning, and increased confidence and ability in wakeboard use and performance.

The invention relates to an easily adjustable and fastenable wakeboard binding and system for use on a wakeboard, to be towed behind a watercraft, which is easily adjustable by various riders, and which wakeboard comprises a variety of components, which in combination, provide for rapid adjustability and high wrap performance and support.

An adjustable wakeboard binding comprises a support plate adapted to be secured to a wakeboard. The heel assembly of an adjustable wakeboard binding forms a heel enclosure for the heel of a user and has an exterior heel surface with a hook and loop-type fastener material thereon. Further, an adjustable wakeboard binding comprises a footpad on the support plate to cushion the foot of the user and a forefoot assembly with the heel assembly, to form a boot-like enclosure for the foot of a user. An adjustable wakeboard includes a binding overlay material which extends, in a crossover relationship, over the forefoot assembly an having extended ends which contain binding hook and loop-type fastener material; the extended ends of sufficient length to extend to the exterior surface of the heel assembly, wherein the binding fastener material is adjustably and removably fastened to the heel fastener material. The binding also includes a clamp means to secure the heel assembly, the forefoot assembly, and the binding overlay material to the support plate. The wakeboard binding comprises a support plate, typically an aluminum plate, which may have a heel, or toe, or both cut out with a foam or elastomeric cushion layer in the heel cut out section. The support plate may have a thin cushion lower support foam layer, which plate is adapted and used to be secured or otherwise fastened to the top surface of the wakeboard.

The binding also includes a footpad, typically a cushion footpad of an elastomeric foam, shaped generally in the shape of a foot, and the toe of which extends slightly beyond the support plate to be flexible, and which also extends, optionally, over an open area in the rear of the support plate, which is open to provide for additional heel support by the insertion of a cushion material in the heel cut out.

The adjustable wakeboard binding includes a heel sheet material or heel assembly, which heel assembly forms a general arcuate heel enclosure, to receive therein the heel portion of the foot of a user, and which includes a lower section and an upper section. Typically, the upper section extends beyond and arcuately about the ankle, back, and sides of the foot of a user, and has an extended pull loop, or one or two finger holes in section therein, to aid the user in forcing the foot into the formed boot-like enclosure of the wakeboard binding. The wakeboard binding includes a heel clamp, generally in a horseshoe shape, extending about and secured closely to the lower portion of the elastomeric-type heel material, so that the lower portion is secured, e.g., threadably fastened to the lower portion and about the heel enclosure to the support plate.

The heel enclosure has an outwardly extending, exterior back heel surface having an adjustable receiver fastener, typically of a hook or loop-type fastener, usually centrally disposed; one portion secured essentially to the exterior surface of the heel enclosure, and the other opposite, fastenable, upwardly extending portion; so that it may be folded down and fastened over other ends of the binding overlay as hereinafter described to secure the binding overlay ends.

The wakeboard binding includes a toe assembly which is generally formed by first and second forefoot sheet materials; typically of an elastomeric, like a metallocene rubber sheet material, each having a lower end and an upper end, and having first and second adjustable hook and loop-type fasteners at the other upper end of each of the sheet materials. When the first and second forefoot sheet materials are crossed over one another in use, they form an open toe, boot-like enclosure over the forefoot. The hook and loop fastener-type material may be suitably engaged, so that the first and second forefoot sheet material may be adjusted snugly about the foot by a user.

One of the forefoot sheet materials has an extended tongue-like upper section, which with the heel assembly forms an opening into the boot-like enclosure of the wakeboard binding for the foot of the user.

Generally, the hook and loop-type fastener means is fastened on one or both sides of the first forefoot sheet material and on one and on the other opposing side as a flap-type on the larger second forefoot sheet material, which may extend to the heel enclosure. However, when the first and second forefoot sheet materials are crossed over by the user and thus fastened at the upper ends, the user's foot is held securely in position to form the foot assembly.

The adjustable wakeboard binding also includes first and second overlay binding sheet materials, also typically of elastomeric material, like a metallocene rubber, having a one lower end and another extended end of sufficient length to extend to the back heel surface, and with each extended end having an adjustable, fastener-type arrangement, so that when the binding overlay is crisscrossed over the exterior of the forefoot sheet material as a binding overlay in a criss-cross relationship, the other end of the binding overlay material would extend toward and to the back exterior surface of the heel enclosure material. The hook and loop-type material therein is fastened adjustably to the hook and loop-type fastener material on the exterior surface of the heel enclosure, and which after being adjusted to the desired tightness of the user, then the overlying heel flap extending upwardly in the rear of the heel enclosure, may be placed down and over the exterior of the binding overlay upper ends to secure the two ends of the binding overlay material in an adjustably, user-tight, fastened position to the heel surface.

The adjustable binder of the invention also includes opposing side fastener clamps secured quickly and usually threadably to the support plate, and which side fastening clamp fastens the lower end of the first and second forefoot sheet materials and also the lower end of the binding sheet material to the support plate.

By such an arrangement, as described, it can be seen that an easily adjustable, well fitted, adjustable, high wrap wakeboard binding may be formed and employed by a user. Accurately adjusting to the differing feet size of a user through the adjustable tightening of the hook and loop-type or other similar type fastening materials, and which is easily released or further adjusted without removal of the heel or side clamps The adjustable wakeboard binding, system and method of the invention will be described for the purpose of illustration only in connection with certain illustrated embodiments; however, it is recognized that those persons skilled in the art may make various modifications, additions, improvements and adjustments in and to the illustrated embodiments without departing from the spirit and scope of the invention as described illustrated.

DESCRIPTION OF THE EMBODIMENTS

Figure 1:
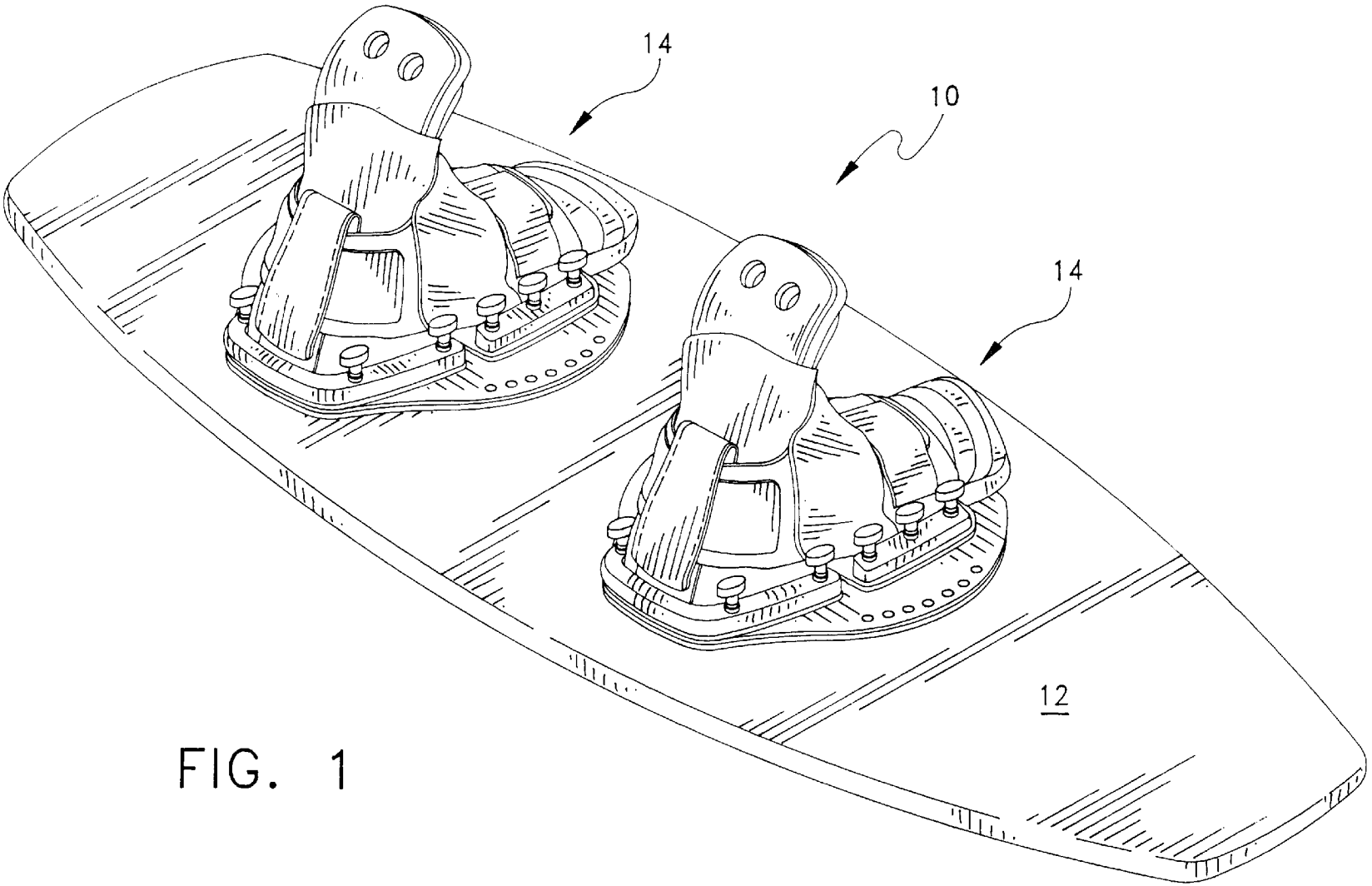
FIG. 1 is a perspective view of a wakeboard with a pair of wakeboard binding of the invention secured thereto.
Figure 2:
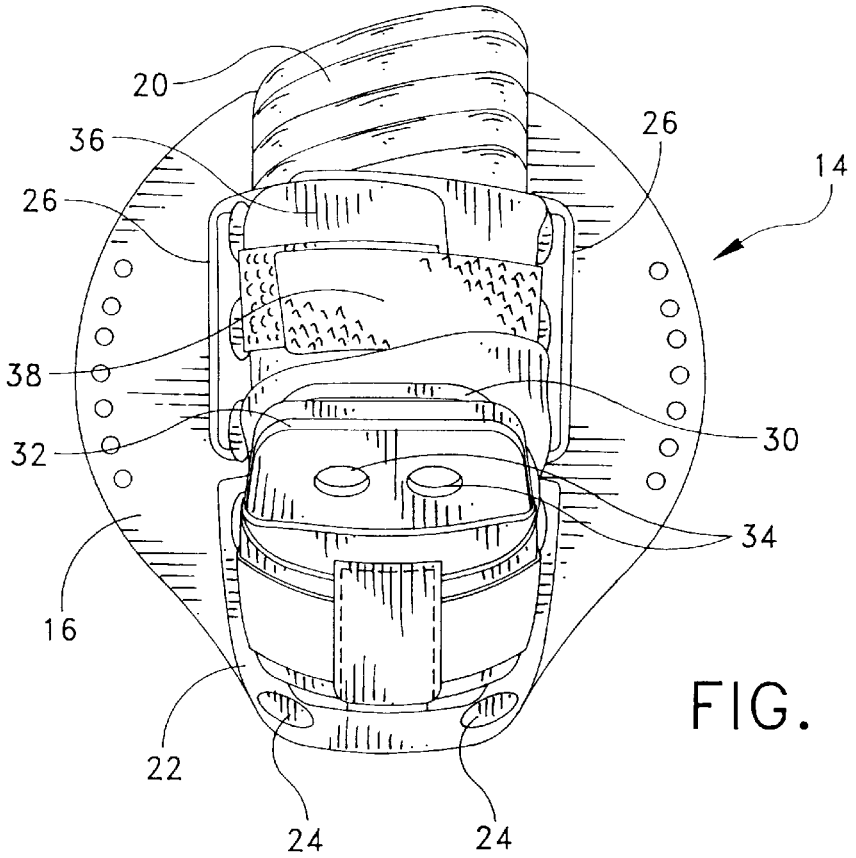
FIG. 2 is a top plan view of one of the user-adjusted wakeboard bindings shown in FIG. 1.
Figure 3:
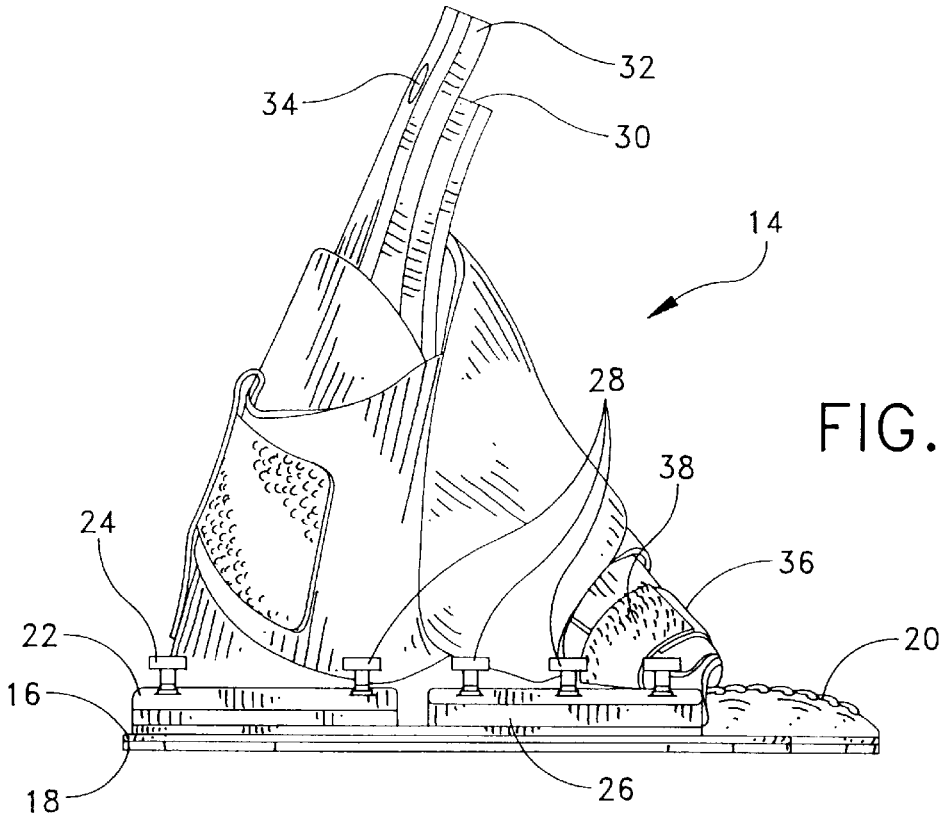
FIG. 3 is a side plan view of the binding of FIG. 2.
Figure 4:
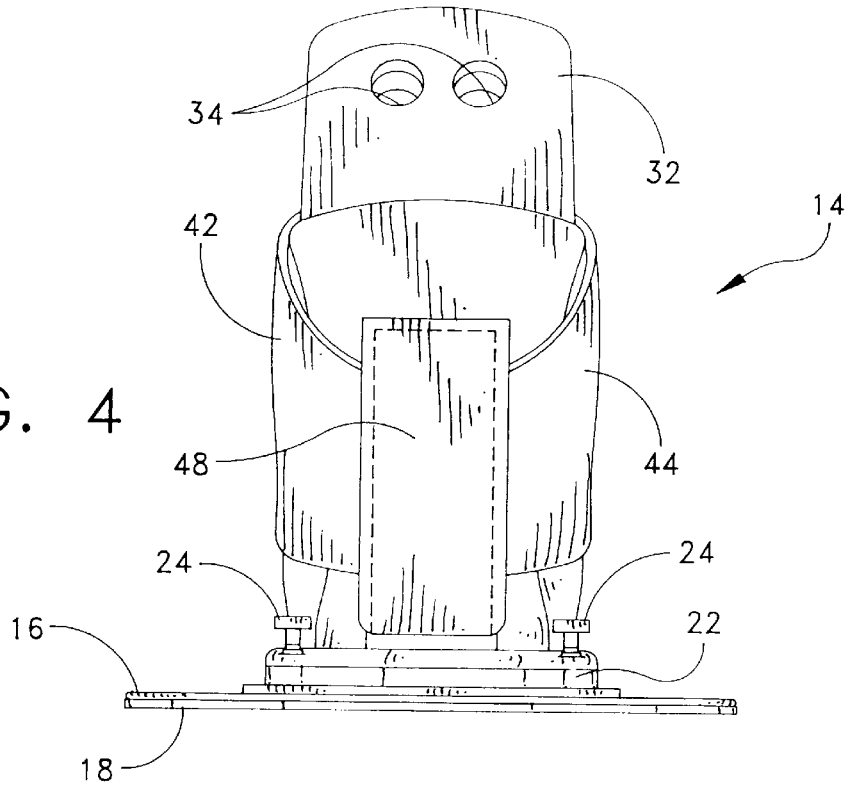
FIG. 4 is a back plan view of the binding of FIG. 2.
Figure 5:
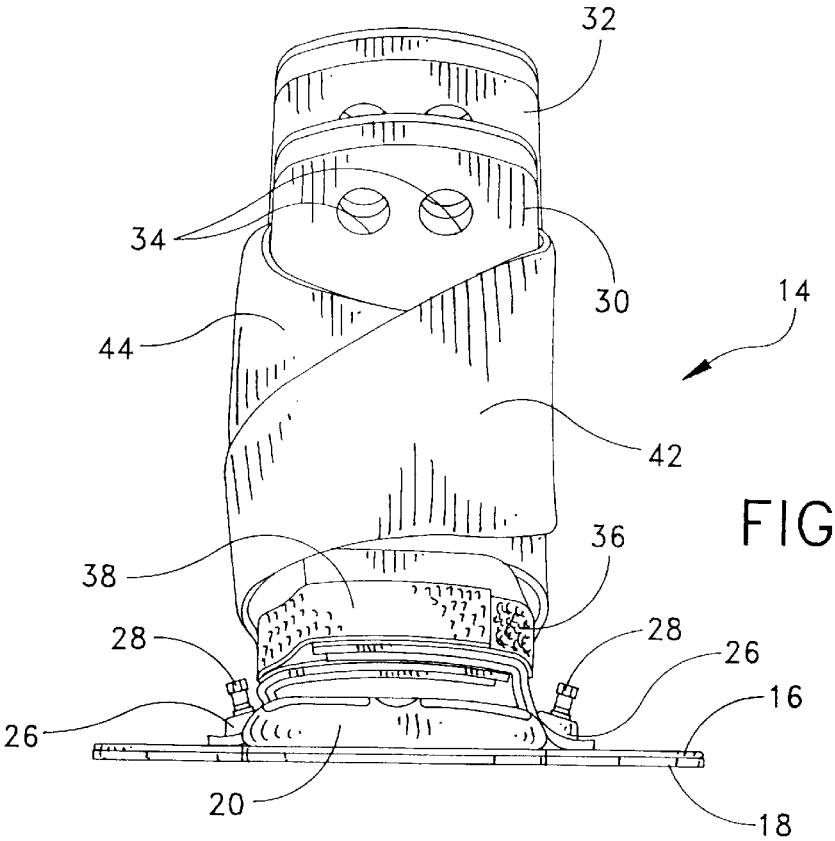
FIG. 5 is a front plan view of the binding of FIG. 2.

FIG. 1 shows a wakeboard binding system 10 with a wakeboard 12 having a pair of adjustable bindings 14 secured to the top surface.

FIGS. 2–5 show the adjustable binding 14 in a user-adjusted position. The binding 14 includes a thin, generally circular, aluminum support plate 16 having a thin foam cushion layer 18 on the bottom, the binding 14 secured to the top surface of the wakeboard 12 in a selected position. The binding 14 includes a foot-shaped, soft, flexible, elastomeric-foam footpad 20 on plate 16 to cushion the user's foot. C-shaped heel clamps 22, with threaded fasteners 24 and straight, opposite, side clamps 26, with side fasteners 28, secure the ends of the sheet material; for example, a cushioned, elastomeric sheet material, like a metallocene elastomer, to the plate 16 and define a heel assembly 30, which defines a heel enclosure for the user, with optional user pull holes 34, and a forefoot assembly 36-38 of overlapping, adjustable flaps, one with an extended tongue 32 to the ankles to form an open toe, boot-like, enclosure with the heel assembly sheets 30–32. The heel assembly extends about the user's ankle to provide a high ankle-support binding. The binding 14 is adjusted in tension about the user's foot and over the exterior of the forefoot flaps 36–38, and provides crossover support about the ankle and foot of a user by overlapping, extended, binding overlays 42–44, which are secured to the support plate 16 at one end and external in length to the back of the heel assembly 30-32.

The heel assembly 30 includes on its exterior, central surface, a heel strap 48 secured; for example, sewn, to the heel assembly rear sheet material 32. The heel strap 48 includes on its surface, a hook and loop-type fastener, such as a VELCRO® fastener arrangement, of selected loops or hooks and engaged to mate in an adjustable, cooperative, removable, closing-fastening relationship with an opposite hook and loop-type surface.

The heel strap 48 includes, optionally but preferably, an extended, central heel flap 50 with a hook and loop-type, interior fastener surface 52, which surface 52 may be engaged adjustably and matingly with an opposite hook and loop-type fastener surface 46 on the extended ends of the overlapping binding overlays 42–44. The hook and loop-type fastener surface 46 extends from sewn straps on both sides of the ends of the binding overlays 42–44, with the fastener surfaces of the opposite structure, to permit the extended ends to be overlapped by a user and removably secured at the desired tension to the fastener surface of the heel strap, with one binding overlay and the ends of the binding overlays 42–44, with the fastener surfaces of the opposite structure, to permit the extended ends to be overlapped by a user and removably secured at the desired tension to the fastener surface of the heel strap. With one binding overlay and the ends of the other binding overlay secured to the fastener surface of the first binding overlay, then the heel flap 50 extends downwardly, and the fastener surface 52 is fastened over the exposed other fastener surface of the binding overlay in a layered fashion. The exterior surface of the heel flap 50 is free of fastener surface and serves to anchor the overlapping ends of the binding overlays 42–44 in place, to provide proper, adjustable support.

Optionally, as illustrated, the support plate 14 may have an arcuate; e.g., circular, cutout directly below the user heel and be filled with a heel cushion material, while the front of the support plate 14 may include an arcuate cutout, to permit forward flexing of the footpad 20 at the end.

The forefoot assembly 36-38 includes overlapping, sheet material flaps, one larger than the other, with adjustable, opposite-surfaced, hook and loop-type fasteners 40 at each end, to provide for a user to cross the forefoot flaps and fasten them together to form the open toe enclosure for the user's foot in front of the heel assembly 30-32. The use of the overlapping flaps 36–38 permit the user to adjust the size of the foot enclosure to the user's foot and permits rapid adjustment for another user.

A variety of adjustable, cooperative, matingly engaged fasteners can be employed, including self-adhesive fasteners; however, selected hook and loop-type fasteners secured to the ends of the binding overlap 42-44, the forefoot flaps 36-38, and to the heel strap and flaps 48–50 in sewn fabric form are preferred. The surfaces are selected to engage with opposite surfaces and may be arranged in a variety of forms and shapes to enable a user to fasten and crossover the forefoot flaps 36–38 and the binding overlays 42–44 quickly and rapidly, after the user has inserted a heel in the preformed heel assembly 30-32. This arrangement, as described, avoids the need for readjusting the threaded fasteners or selecting a particular binding size for the average wakeboard user.

Figure 6:
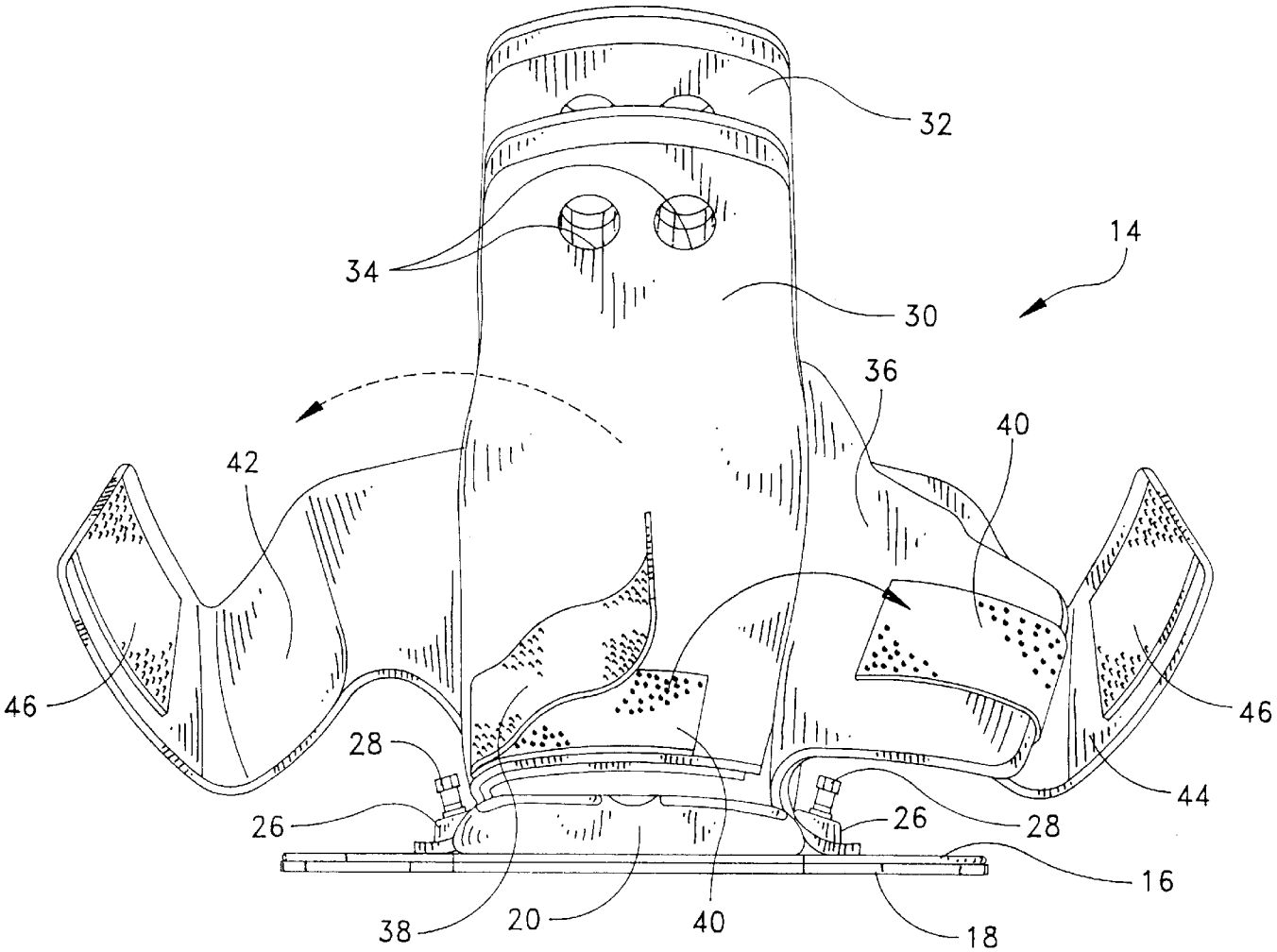
FIG. 6 is a front plan view of the binding of FIG. 5 prior to user's adjusting the binding.
Figure 7:
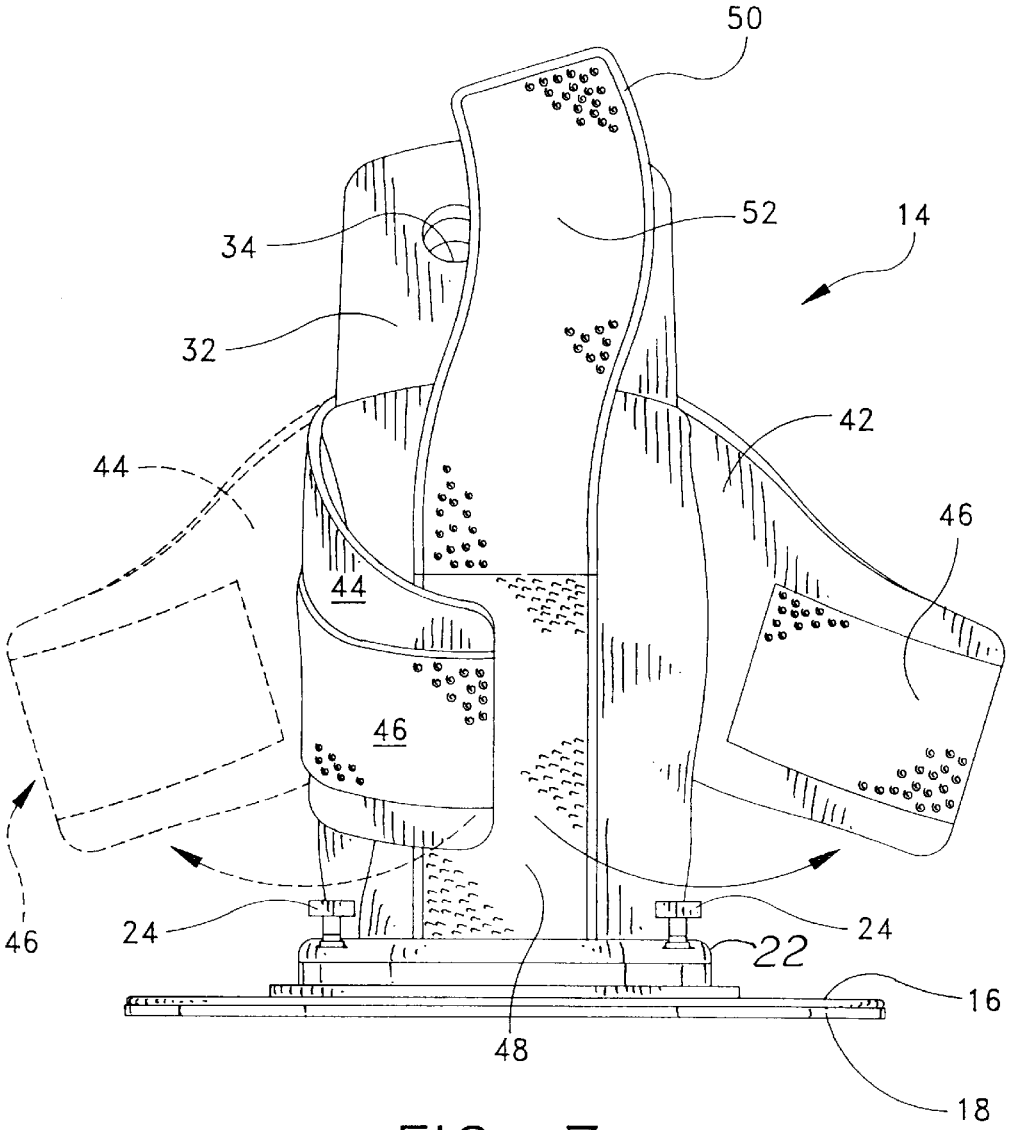
FIG. 7 is a back plan view of the binding of FIG. 4 prior to the user's adjusting the binding.

FIGS. 6 and 7 illustrate the adjustable binding 14 prior to adjustment of the binding by a user. The user places one forefoot 36 over the other flap 38 and secures the flaps 36–38 to the opposite, engaging, hook and loop-type fasteners 40 on the flap ends, to provide the correct fit over the foot of the user. The binding overlays 42–44 are then wrapped in crisscross fashion over the exterior of the adjusted forefoot assembly, and the extended ends, with the fasteners 46 secured as a VELCRO® strap on each side, fastened first on one overlay to the fastener 48 of the heel strap, and then the other overlay fastened to the surface of the first overlay, with the user adjusting the tightness to provide selected ankle and foot support. The extended flap 50; e.g., a nylon strap, with hook and loop-type fasteners on the interior surface 52, is then fastened over the exposed, opposite fastener surface of the other overlay, to complete the binding 14 about the foot (see FIGS. 2–5). The use of the double wrap overlay binding allows for a rapid and adjustable custom fit and creates the advantages of a high wrap ankle binding for a wakeboard.

What is claimed is:

1. An adjustable wakeboard binding for use with a wakeboard, which binding comprises:

a) a support plate adapted in use to be secured to a wakeboard;

b) a user foot pad secured to the support plate for the foot of a user;

c) a heel sheet material to form a general heel-shaped enclosure to receive the heel of a user and having a lower section and an upper section;

d) a heel clamp means to secure the lower portion of the heel sheet material to the support plate;

e) the heel material having an exterior heel surface, with a heel hook or loop fastener material secured thereto, and adapted to receive and interlock with an opposing hook or loop fastener thereon;

f) first and second forefoot sheet material, each having a one lower end and another upper end, and each having at the upper end, first and second hook or loop fasteners, so that on the crossover of the ends of the first and second forefoot sheet material, a boot enclosure is formed for the forefoot of the user;

g) first and second overlay binding sheet materials, each having a one lower end and another extended end, and each extended end having a hook or loop fastener, with the extended end extending in length to the exterior heel surface, so that on crossover of the binding overlay sheet material over the exterior of the forefoot first and second sheet material, each extended end of the binding overlay sheet material is adjustably fastened to the exterior heel fastener material, to provide support for the ankle of a user; and h) a side clamp means fastened to the support plate, each of the side clamp means securing the lower end of the first and second forefoot material, and the lower end of the first and second crossover, overlay binding sheet material to the support plate, thereby providing for a fully adjustable wakeboard binding.

2. The binding of claim 1 wherein the heel fastener material includes a hook or loop fastener material extending generally exterior and longitudinally of the exterior heel surface, and includes an outwardly extending flap with opposing hook or loop fastener material to secure overlapped, fastened, extended ends of the binding sheet materials between the flap and the heel exterior surface.

3. The binding of claim 1 wherein the first forefoot sheet material contains hook or loop fastener material on either side of said material; and the second forefoot sheet material includes opposing hook or loop fastener material to interlock with the first forefoot sheet material to provide for the fastening of the fastener material of the first forefoot sheet material between the fastener material of the second forefoot sheet material and the extended flap.

4. The binding of claim 1 wherein the foot pad comprises an elastomeric cushion foot pad which extends beyond the support plate, and wherein the support plate is characterized by an open section, with a heel cushion material therein, directly beneath the heel of the foot pad.

5. The binding of claim 1 wherein the heel, forefoot, and binding overlay sheet materials comprise an elastomeric metallocene sheet material.

6. The binding of claim 1 wherein the heel sheet material comprises a heel sheet material to form a heel enclosure; and a separate, adjacent, extended heel sheet material which extends upwardly therefrom, and is interior thereof, and which contains means to aid a user in inserting a foot into the heel enclosure.

7. The binding of claim 1 wherein the heel hook or loop fastener material comprises a strap material, generally centrally and longitudinally secured to the exterior surface of the heel material.

8. A wakeboard having an exterior top surface and the wakeboard binding of claim 1 secured to said surface.

9. An adjustable wakeboard binding which comprises:

a) a support plate adapted to be secured to a wakeboard;

b) a heel assembly to form a heel enclosure for the heel of a user and having an exterior heel surface with a hook or loop heel fastener material thereon;

c) a footpad on the support plate to cushion the foot of the user;

d) a forefoot assembly with the heel assembly, to form a boot enclosure for the foot of a user;

e) first and second binding overlay sheet materials which extend, in a crossover relationship, over the forefoot assembly and having extended ends which contain hook or loop fastener material, the extended ends of sufficient length to extend to the exterior surface of the heel assembly, wherein the binding fastener material is adjustably and removably fastened to the heel fastener material; and f) clamp means to secure the heel assembly, the forefoot assembly, and the binding overlay material to the support plate.

10. The binding of claim 9 wherein the heel fastener material comprises a longitudinal, central strap material.

11. The binding of claim 9 wherein the heel fastener material includes an extended flap having hook or loop fastener material and adapted to be placed over and fastened to the binding overlay material secured to the heel fastener material.

12. The binding of claim 9 wherein the extended ends of the binding overlay sheet materials include hook or loop fasteners on opposing end surfaces of the extended ends of the binding overlay material.

13. The binding of claim 9 wherein the forefoot assembly includes overlapping forefoot sheet materials, each with free ends, with hook or loop fasteners at each free end to permit tensioned adjustment of the forefoot assembly about the foot of a user.

14. The binding of claim 9 wherein the heel assembly and the forefoot assembly both extend above the ankle of the user.

15. The binding of claim 9 wherein the heel assembly, forefoot assembly, and binding overlay comprise an elastomeric, metallocene sheet material.

16. A wakeboard having a top surface and the binding of claim 9 secured to said surface.

17. The binding of claim 9 wherein the upper end of the second forefoot sheet material and the upper section of the heel sheet material both extend above the ankle of a user.

18. The binding of claim 17 wherein the upper end of the second forefoot sheet material and the upper section of the heel sheet material both are characterized by a pair of spaced-apart, pull-on holes.

19. The binding of claim 9 wherein the extended end of the first overlay binding sheet material includes the same hook or loop fastener material on both interior and exterior end surfaces and the extended end of the second overlay binding sheet material includes opposing same hook or loop fastener material on both the interior and exterior end surfaces.

20. The binding of claim 9 wherein the extended ends of the binding overlay sheet material are fastened in an overlapping fastened position between the heel fastener material and the extended flap.

21. The binding of claim 9 wherein the support plate is characterized by an open section under the heel of a user and includes therein a heel cushion material.

* * * * *